US005236407A

United States Patent [19]

Wang

[11] Patent Number: 5,236,407

[45] Date of Patent: Aug. 17, 1993

[54] HYDRAULIC EXERCISER

[75] Inventor: John Wang, Chiayi City, Taiwan

[73] Assignee: Lee Wang Industry Ltd., Chiayi Hsien, Taiwan

[21] Appl. No.: 978,903

[22] Filed: Nov. 19, 1992

[51] Int. Cl.[5] ..... A63B 22/04; A63B 21/008

[52] U.S. Cl. ..... 482/113; 482/53

[58] Field of Search ..... 482/51, 52, 53, 111, 482/112, 113

[56] References Cited

U.S. PATENT DOCUMENTS

| | | | |
|---|---|---|---|
| 4,685,666 | 8/1987 | DeCloux | 482/113 |
| 4,733,858 | 3/1988 | Lan | 482/113 |
| 4,946,162 | 8/1990 | Lubie | 482/113 |
| 5,139,470 | 8/1992 | Wang | 482/113 |

*Primary Examiner*—Stephen R. Crow
*Attorney, Agent, or Firm*—Harness, Dickey & Pierce

[57] ABSTRACT

A hydraulic exerciser includes a base and a pair of driven units which are mounted pivotably on the base. A rigid tubular connector is secured on the base and extends between the driven units. The tubular connector has two ends which are provided with an annular peripheral groove and a fluid hole that is formed in the peripheral groove. Each of a pair of hydraulic cylinders includes a cylinder body, a piston movably disposed inside the cylinder body, a piston rod connected to the piston and having one end which extends out of the cylinder body and which is mounted pivotably to a respective one of the driven units, and a plug which is secured on one end of the cylinder body and which mounts pivotably the cylinder body on a respective one of the two ends of the tubular connector. The piston, the cylinder body and the plug cooperatively define a volume variable fluid chamber which is filled with hydraulic fluid. The plug is formed with a fluid hole that is aligned with the peripheral groove so as to communicate the fluid chamber and the interior of the tubular connector.

5 Claims, 4 Drawing Sheets

HYDRAULIC EXERCISER

BACKGROUND OF THE INVENTION

1. Field of the Invention

The invention relates to a hydraulic exerciser, more particularly to a hydraulic exerciser which is provided with a pair of reciprocating hydraulic cylinders.

2. Description of the Related Art

Hydraulic exercisers, such as hydraulic steppers and rowing machines, are known in the art. Referring to FIG. 1, a conventional hydraulic stepper is shown to comprise a base (A1) and a pair of driven units (A2) which are mounted pivotably on the base (A1). Each of a pair of hydraulic cylinders (A3) has a cylinder body, which is mounted pivotably on the base (A1), and a piston rod which has one end that is mounted pivotably to a respective one of the driven units (A2). A support (A4) is secured on the base (A1). A linkage (A5) is mounted rotatably on the support (A4) and has two oppositely extending arms which are connected pivotably to a respective one of the driven units (A2). The linkage (A5) permits reciprocating movement of the driven units (A2), that is, downward movement of one of the driven units (A2) results in the corresponding upward movement of the other one of the driven units (A2).

The hydraulic cylinders (A3) resist movement of the driven units (A2) and contain hydraulic fluid which flows from one end of the cylinder body to the other end of the same via a fluid hole that is formed in a piston (not shown) which is disposed slidably inside the cylinder body whenever the respective piston rod is extended from or is retracted into the cylinder body. The fluid hole is designed so as to control the flow of hydraulic fluid in a predetermined direction, thereby permitting the generation of a resistance to the movement of the driven units (A2).

Note that in the conventional hydraulic stepper, the maximum vertical displacement of the driven units (A2) is limited by the linkage (A5). The linkage (A5), however, is a necessary element of the conventional hydraulic stepper since it is responsible for the reciprocating action of the driven units (A2).

SUMMARY OF THE INVENTION

Therefore, the main objective of the present invention is to provide a hydraulic exerciser which is provided with a pair of reciprocating hydraulic cylinders that obviates the need for the linkage which is usually found in the prior art.

Accordingly, the preferred embodiment of a hydraulic exerciser of the present invention comprises:

a base;

a pair of driven units mounted pivotably on the base;

a rigid tubular connector secured on the base and extending between the driven units, said tubular connector having two ends provided with an annular peripheral groove and a fluid hole formed in the peripheral groove; and a pair of hydraulic cylinders, each of the hydraulic cylinders including a cylinder body, a piston movably disposed inside the cylinder body, a piston rod connected to the piston and having one end which extends out of the cylinder body and which is mounted pivotably to a respective one of the driven units, and a plug which is secured on one end of the cylinder body and which mounts pivotably the cylinder body on a respective one of the two ends of the tubular connector; said piston, said cylinder body and said plug cooperatively defining a volume variable fluid chamber which is filled with hydraulic fluid; said plug being formed with a fluid hole that is aligned with the peripheral groove so as to communicate the fluid chamber and the interior of the tubular connector.

Whenever a downward pushing force is applied on one of the driven units, the piston of the corresponding one of the hydraulic cylinders moves downward and causes the hydraulic fluid inside the fluid chamber to flow to the fluid chamber of the other one of the hydraulic cylinders via the tubular connector, thereby causing upward movement of the piston in the other one of the hydraulic cylinders so as to result in the upward movement of the other one of the driven units.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
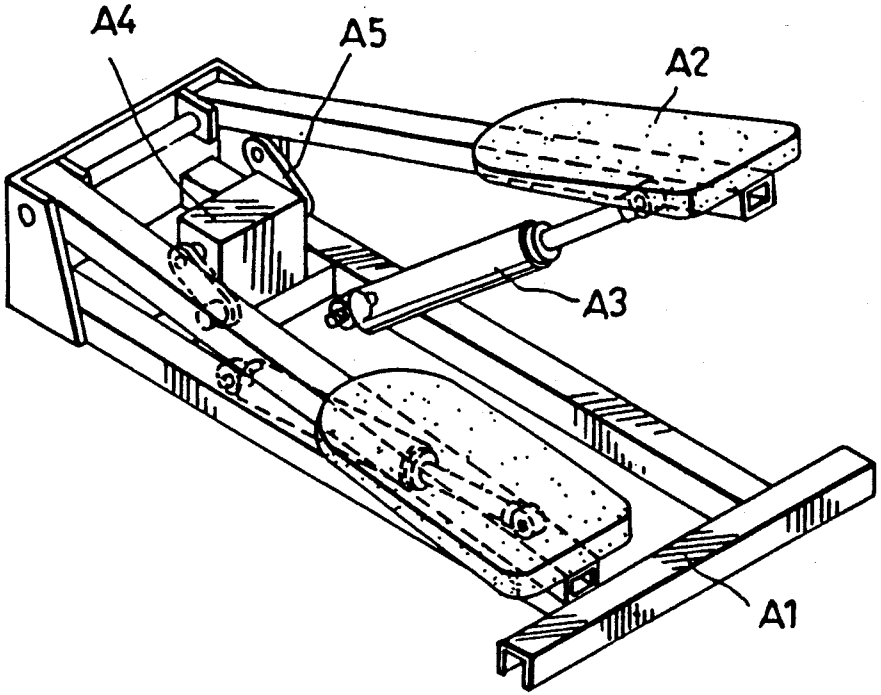
FIG. 1 PRIOR ART
FIG. 1 is an illustration of a conventional hydraulic exerciser.
Figure 2:
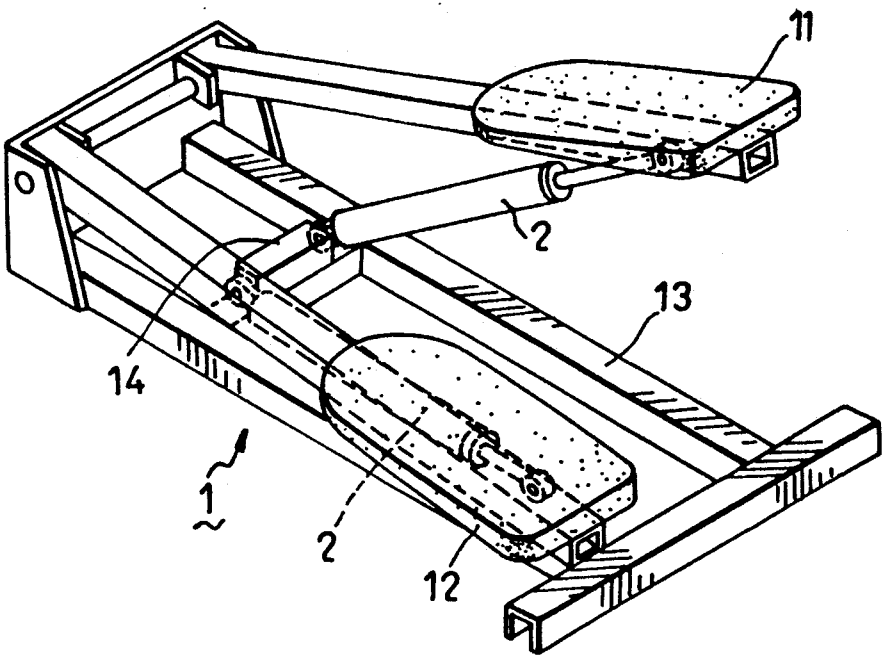
FIG. 2 is an illustration of a hydraulic stepper according to the hydraulic exerciser of the present invention.

Referring to FIG. 2, the preferred embodiment of a a hydraulic exerciser (1) according to the present invention is shown to be configured as a hydraulic stepper and comprises a base (13) and a pair of elongated driven units (11, 12). Each of the driven units (11, 12) has one end which is mounted pivotably on the base (13). A support (14) is secured on the base (13) and is disposed between the driven units (11, 12).

Figure 3:
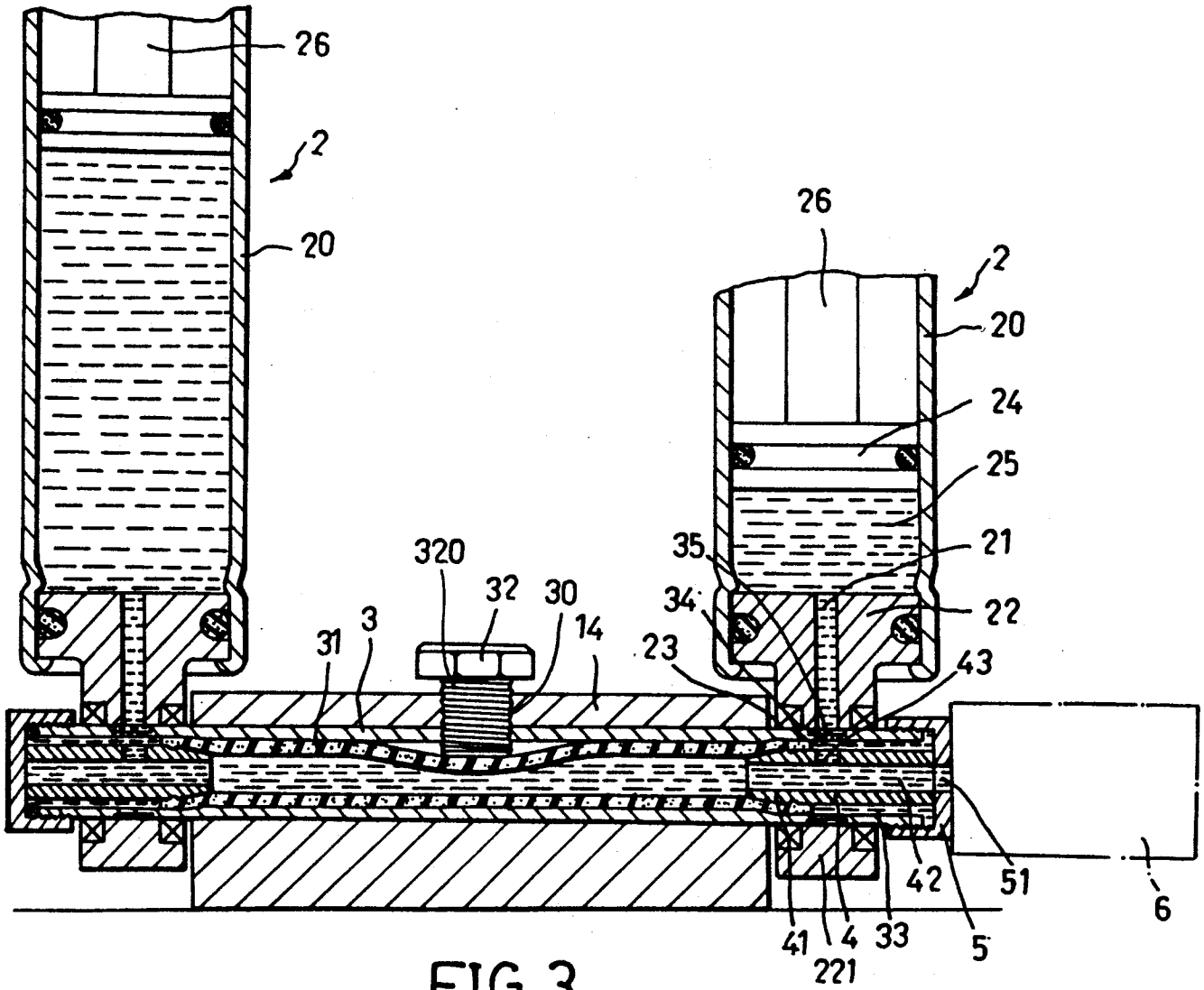
FIG. 3 is a sectional view of the hydraulic stepper shown in FIG. 2.

Referring to FIGS. 2 and 3, each of a pair of hydraulic cylinders (2) has a cylinder body (20), which is mounted pivotably on one side of the support (14), and a piston rod (26) which has one end that is mounted pivotably to a respective one of the driven units (2). A metal tubular connector (3) is secured on the support (14) and extends between the driven units (11, 12). The tubular connector (3) has two ends that extend through opposite sides of the support (14) so as to permit mounting of the cylinder bodies (20) of the hydraulic cylinders (2) thereon. The tubular connector (3) has a flexible rubber tube (31) provided therein. The tubular connector (3) is further provided with a radial threaded bore (30) which receives the threaded shank (320) of a rotary knob (32). The rotary knob (32) is operable so as to vary the degree of insertion of the threaded shank (320) inside the tubular connector (3) in order to pinch a portion of the rubber tube (31) and regulate the flow of fluid therethrough. A rigid tubular end piece (4) is provided at each end of the rubber tube (31). Each tubular end piece (4) has a tapered portion (41) which is fitted in the respective end of the rubber tube (31) and which causes the respective end of the rubber tube (31) to expand and press tightly against the tubular connector (3) in order to seal the gap between the the tubular connector (31) and the tubular connector (3). Each of the tubular end pieces (4) defines a fluid path (42) and is provided with a radial hole (43) which is communicated with the fluid path (42). A cap (5) is mounted threadedly on each end of the tubular connector (3) and is used to retain the end pieces (4) and the rubber tube (31) inside the tubular connector (3). A clearance (33) is formed between a portion of the tubular end piece (4) and the tubular connector (3). One of the caps (5) is provided with a fluid inlet (51). The fluid inlet (51) is adapted to be connected to a hydraulic fluid supply (6) which is used to remove or supply hydraulic fluid to the rubber tube (31). The construction and operation of the hydraulic fluid supply (6) is known in the art and will not be detailed herein.

Figure 4:
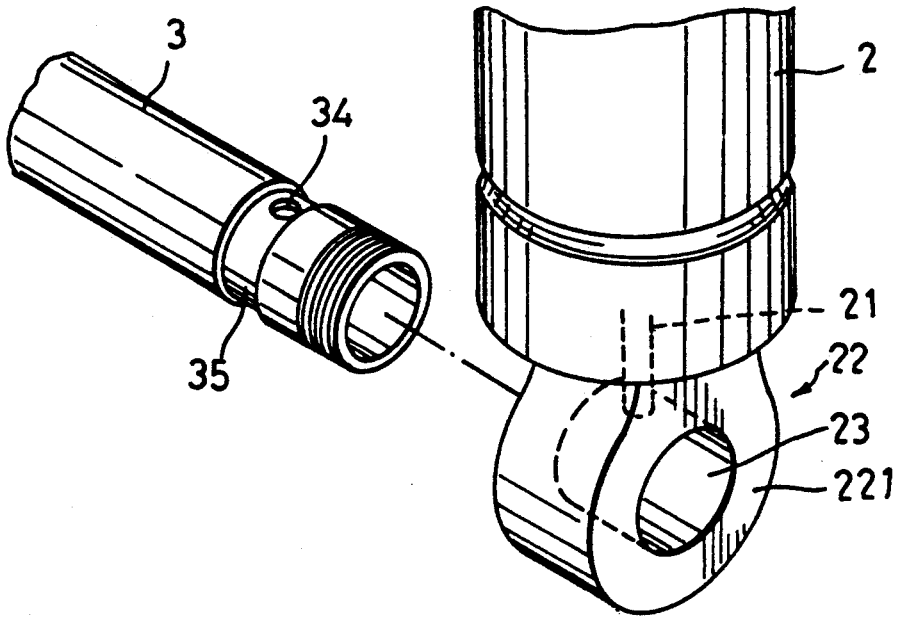
FIG. 4 is an exploded view which illustrates how a hydraulic cylinder of the hydraulic stepper is mounted pivotably on a tubular connector in accordance with the present invention.

Referring to FIGS. 3 and 4, the cylinder body (20) of each hydraulic cylinder (2) has one end which is provided with a plug (22). The plug (22) is formed with a ring connector (221) that defines a through hole (23). The plug (22) is further provided with an axial fluid hole (21) which communicates the interior of the cylinder body (20) with the through hole (23). A piston (24) is disposed movably inside the cylinder body (20) and is connected to one end of the piston rod (26). The piston (24) cooperates with the cylinder body (20) and the plug (22) so as to define a volume variable fluid chamber (25) which is filled with hydraulic fluid. The ring connectors (221) of the hydraulic cylinders (2) are sleeved on a respective end of the tubular connector (3), thereby mounting pivotably the hydraulic cylinders (2) on the tubular connector (3). Each end of the tubular connector (3) is further provided with an annular peripheral groove (35) and a fluid hole (34) that is formed in the peripheral groove (35). The peripheral groove (35) is aligned with the fluid hole (21) of the plug (22) and permits the flow of hydraulic fluid from the fluid chamber (25) to the clearance (33) via the fluid hole (34), and vice versa.

The operation of the hydraulic exerciser (1) is as follows: Referring to FIGS. 2 to 4, whenever a downward pushing force is applied on one of the driven units (11, 12), the piston (24) of the corresponding hydraulic cylinder (2) moves downward, thereby causing the hydraulic fluid inside the fluid chamber (25) to flow through the fluid hole (21), the peripheral groove (35), the fluid hole (34), the clearance (33), the radial hole (43) of one of the tubular end pieces (4), the fluid path (42) and into the rubber tube (31). Fluid inside the rubber tube (31) then flows through the fluid path (42) of the other tubular end piece (4), the radial hole (43), the clearance (33), the fluid hole (34), the peripheral groove (35), the fluid hole (21) and into the fluid chamber (25) of the other hydraulic cylinder (2). The entry of hydraulic fluid in the fluid chamber (25) causes upward movement of the piston (24) in the other hydraulic cylinder (2), thereby resulting in the upward movement of the other one of the driven units (11, 12).

Note that the rotary knob (32) can be operated so as to vary the degree of insertion of the threaded shank (320) inside the tubular connector (3) in order to pinch a portion of the rubber tube (31) and regulate the transfer of hydraulic fluid between the hydraulic cylinders (2), thereby varying the resistance offered by the hydraulic cylinders (2) to the movement of the driven units (11, 12).

In addition, the maximum vertical displacement of the driven units (11, 12) may be adjusted according to the user's needs by simply adding or removing hydraulic fluid from the rubber tube (31) by means of the hydraulic fluid supply (6).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A hydraulic exerciser, comprising:

a base;

a pair of driven units mounted pivotably on said base;

a rigid tubular connector secured on said base and extending between said driven units, said tubular connector having two ends provided with an annular peripheral groove and a fluid hole formed in said peripheral groove; and a pair of hydraulic cylinders, each of said hydraulic cylinders including a cylinder body, a piston movably disposed inside said cylinder body, a piston rod connected to said piston and having one end which extends out of said cylinder body and which is mounted pivotably to a respective one of said driven units, and a plug which is secured on one end of said cylinder body and which mounts pivotably said cylinder body on a respective one of said two ends of said tubular connector; said piston, said cylinder body and said plug cooperatively defining a volume variable fluid chamber which is filled with hydraulic fluid; said plug being formed with a fluid hole that is aligned with said peripheral groove so as to communicate said fluid chamber and the interior of said tubular connector;

whereby, whenever a downward pushing force is applied on one of said driven units, said piston of the corresponding one of said hydraulic cylinders moves downward and causes the hydraulic fluid inside said fluid chamber to flow to said fluid chamber of the other one of said hydraulic cylinders via said tubular connector, thereby causing upward movement of said piston in the other one of said hydraulic cylinders so as to result in the upward movement of the other one of said driven units.

2. The hydraulic exerciser as claimed in claim 1, wherein said plug of each of said hydraulic cylinders is formed with a ring connector which is sleeved on the respective one of said ends of said tubular connector so as to mount pivotably said hydraulic cylinders on said tubular connector.

3. The hydraulic exerciser as claimed in claim 1, further comprising:

a flexible tube provided inside said tubular connector; and a pair of rigid tubular end pieces, each of said tubular end pieces having a portion which is fitted in a respective end of said flexible tube and which causes the respective end of said flexible tube to expand and press tightly against said tubular connector, each of said tubular end pieces being provided with a radial hole which is aligned with a corresponding one of said fluid holes of said tubular connector.

4. The hydraulic exerciser as claimed in claim 3, wherein:

said tubular connector is provided with a radial threaded bore; and said hydraulic exerciser further comprises a rotary knob with a threaded shank that is received in said threaded bore, said rotary knob being operable so as to vary the degree of insertion of said threaded shank inside said tubular connector in order to pinch a portion of said flexible tube and regulate the transfer of said hydraulic fluid between said hydraulic cylinders.

5. The hydraulic exerciser as claimed in claim 1, further comprising:

a cap which is mounted detachably on one of said ends of said tubular connector, said cap being provided with a fluid inlet; and a hydraulic fluid supply which is adapted to be connected to said fluid inlet so as to remove or supply said hydraulic fluid to the interior of said tubular connector.

* * * * *

UNITED STATES PATENT AND TRADEMARK OFFICE

CERTIFICATE OF CORRECTION

PATENT NO. : 5,236,407

DATED : August 17, 1993

INVENTOR(S) : John Wang

It is certified that error appears in the above-identified patent and that said Letters Patent is hereby corrected as shown below:

Column 2, line 36 (second occurrence), delete "a"

Column 3, lines 1-2, "the tubular connector" should be --rubber tube--.

Signed and Sealed this

Fifth Day of April, 1994

Bruce Lehman

*Attest:*

BRUCE LEHMAN

*Attesting Officer*

*Commissioner of Patents and Trademarks*